US007633389B2

(12) United States Patent
Mantovani et al.

(10) Patent No.: US 7,633,389 B2
(45) Date of Patent: Dec. 15, 2009

(54) LOCATION ENABLED DEVICE WITH POWER SAVING CONTROL AND METHOD THEREOF

(75) Inventors: Jose Ricardo B. Mantovani, Mundelein, IL (US); Bruce A. Bernhardt, Wauconda, IL (US)

(73) Assignee: Motorola, Inc., Schaumburg, IL (US)

( * ) Notice: Subject to any disclaimer, the term of this patent is extended or adjusted under 35 U.S.C. 154(b) by 281 days.

(21) Appl. No.: 11/404,275

(22) Filed: Apr. 14, 2006

(65) Prior Publication Data

US 2007/0241888 A1 Oct. 18, 2007

(51) Int. Cl.
*G08B 1/08* (2006.01)

(52) U.S. Cl. ..... 340/539.3; 340/539.13; 340/693.3

(58) Field of Classification Search ..... 340/539.3, 340/539.11, 539.21, 539.23, 540, 693.3, 340/539.13; 701/213; 342/357.1, 357.14, 342/464; 709/236; 455/517, 574, 456
See application file for complete search history.

(56) References Cited

U.S. PATENT DOCUMENTS

| | | | | |
|---|---|---|---|---|
| 6,037,748 | A | 3/2000 | Yee et al. | |
| 6,067,460 | A | 5/2000 | Alanara et al. | |
| 6,438,381 | B1 | 8/2002 | Alberth, Jr. et al. | |
| 6,584,331 | B2 | 6/2003 | Ranta | |
| 6,700,533 | B1 * | 3/2004 | Werb et al. | 342/357.07 |
| 6,720,922 | B2 * | 4/2004 | Williams et al. | 342/465 |
| 6,975,941 | B1 * | 12/2005 | Lau et al. | 701/213 |
| 6,993,592 | B2 * | 1/2006 | Krumm et al. | 709/236 |
| 7,293,104 | B2 * | 11/2007 | Krumm et al. | 709/236 |
| 2005/0113124 | A1 | 5/2005 | Syrjarinne et al. | |
| 2005/0280576 | A1 * | 12/2005 | Shemesh et al. | 342/357.1 |

FOREIGN PATENT DOCUMENTS

| | | | |
|---|---|---|---|
| GB | 2 357 673 | A | 6/2001 |
| WO | 2005/067493 | A2 | 7/2005 |

OTHER PUBLICATIONS

Robert Shear; "Piezoelectric Sensors for OEM Applications"; Sensors—Feb. 1999; 6-pages.

* cited by examiner

*Primary Examiner*—Van T. Trieu
(74) *Attorney, Agent, or Firm*—Gary J. Cunningham

(57) ABSTRACT

An energy constrained device (100) includes a motion sensor (150) operative to detect motion of the device (100); a device position determinator (130); and a controller (110) operatively coupled at the motion sensor (150) and to the device position determinator (130) and operative to receive a device location request for the energy constrained device (100), to determine whether the energy constrained device (100) has moved based on the motion sensor (150), and to determine whether to request position information from the device position determinator (130) based on device movement. A method for saving power for a device position determinator (130) in a energy constrained device (100) includes determining whether position information has been requested from the device position determinator (130); and if not so, automatically switching the device position determinator (130) to a low power consumption mode.

18 Claims, 4 Drawing Sheets

LOCATION ENABLED DEVICE WITH POWER SAVING CONTROL AND METHOD THEREOF

FIELD OF THE INVENTION

The invention relates generally to mobile electronic devices that include device position determinators and more particularly to energy constrained, mobile electronic devices that include device position determinators.

BACKGROUND OF THE INVENTION

Mobile electronic devices, such as handheld position sensing devices are battery operated and need to be power efficient. Also, other mobile electronic devices such as cellular telephones, internet appliances, personal digital assistants (PDA) and other devices are being used for more than just providing voice and visual communication between parties or user. Today, such electronic devices are equipped with device position determinators, such as global positioning system (GPS) measurement circuitry, signal triangulation circuits or other satellite and non-satellite based position measurement circuitry that are capable of determining the position of the electronic device relative to a given point. The presence of position measurement circuitry on mobile electronic devices facilitates new features or new feature combinations. For example, mobile devices, such as cellular telephones can be used by parents to track the location of children or teenagers and other services may use the location of the device to provide content, map information, directions and other information.

The on-board device position determinator periodically obtains position information regarding the location of the device. Periodic position updating provides the mobile, battery powered device with necessary position data to enable a location function. Once established, the position information may require refreshing periodically. The position information update rate depends on the type of application performed by the device. Some applications require constant position information updates. For example, when a device is used for tracking, or "geo fencing", the position information must be frequently updated and reported to the cellular network. Vehicle navigation requires real-time position information to function properly. Other applications, such as emergency 911 locating, operate on a "locate on demand" basis and do not require frequent updates of position information. In addition, where periodic position information updating is required, the frequency of these updates depends on factors such as anticipated travel speeds or required accuracy such that, for example, vehicle navigation applications may require substantially higher position information update rates than pedestrian tracking applications.

Periodic position information determination may represent a significant power drain for a mobile device battery due to excessive current drain. For example, an on-board GPS receiver may draw an average current of about 35 mA when fully activated. During continuous vehicle navigation, a position information refresh rate of about 1 fix/second will result in a continuous current drain of about 35 mA. People tracking applications operating at a position information refresh rate of about 1 fix/minute may result in an average current drain of about 1.2 mA. Current drains at these levels are sufficient to significantly reduce the operating time for the mobile device. Premature interruption of service due to complete battery discharge is a serious issue if the mobile device is used for security or safety purposes. In addition, the need to frequently recharge the mobile device discourages use of the device and can be a serious issue for applications where, for example, a child must remember to frequently recharge the device. Reducing power consumption in location enabled battery powered devices is useful for improving product usefulness.

BRIEF DESCRIPTION OF THE DRAWINGS

The present invention and the corresponding advantages and features provided thereby will be best understood and appreciated upon review of the following detailed description of the invention, taken in conjunction with the following drawings, where like numerals represent like elements, in which.

DETAILED DESCRIPTION OF THE INVENTION

A method saves power in a location enabled, energy constrained device by, among other aspects, eliminating unneeded position information updates. In an exemplary embodiment of the present invention, an energy constrained device, such as a cellular telephone, includes a device position determinator, such as for GPS measurement, a motion sensor operative to detect device movement, and a controller operative to determine when to request position information. Device position information is not requested from the device position determinator if the motion sensor indicates that the device has not moved. Movement may be any suitable amount depending on the accuracy of the location receiver and desired application. Unnecessary power consumed during the position information update is thereby eliminated. In addition, the device position determinator may automatically enter a low power mode when the device has not moved over a time period.

As such, a method and apparatus is disclosed that permits a savings in battery power by eliminating unnecessary position information requests to the device position determinator and, if desired, by operating the device position determinator in a low power consumption mode when possible. As a consequence, unnecessary battery consumption can be avoided to thereby extend device operation between battery charges, extend battery life, improve device usefulness, and enhance consumer satisfaction. Substantial power savings may be achieved. Energy constrained devices include, but are not limited to, devices powered by batteries, fuel cells, and solar conversion devices. By comparison, devices that are exclusively powered directly from an electrical utility service, for example, would not be energy constrained since an electric utility service can supply unlimited power to the device over time. While exemplary embodiments herein describe battery power devices, it is understood that the method and apparatus disclosed are applicable to any energy constrained device. An exemplary embodiment of the present invention will now be described with reference to FIGS. 1-5.

Figure 1:
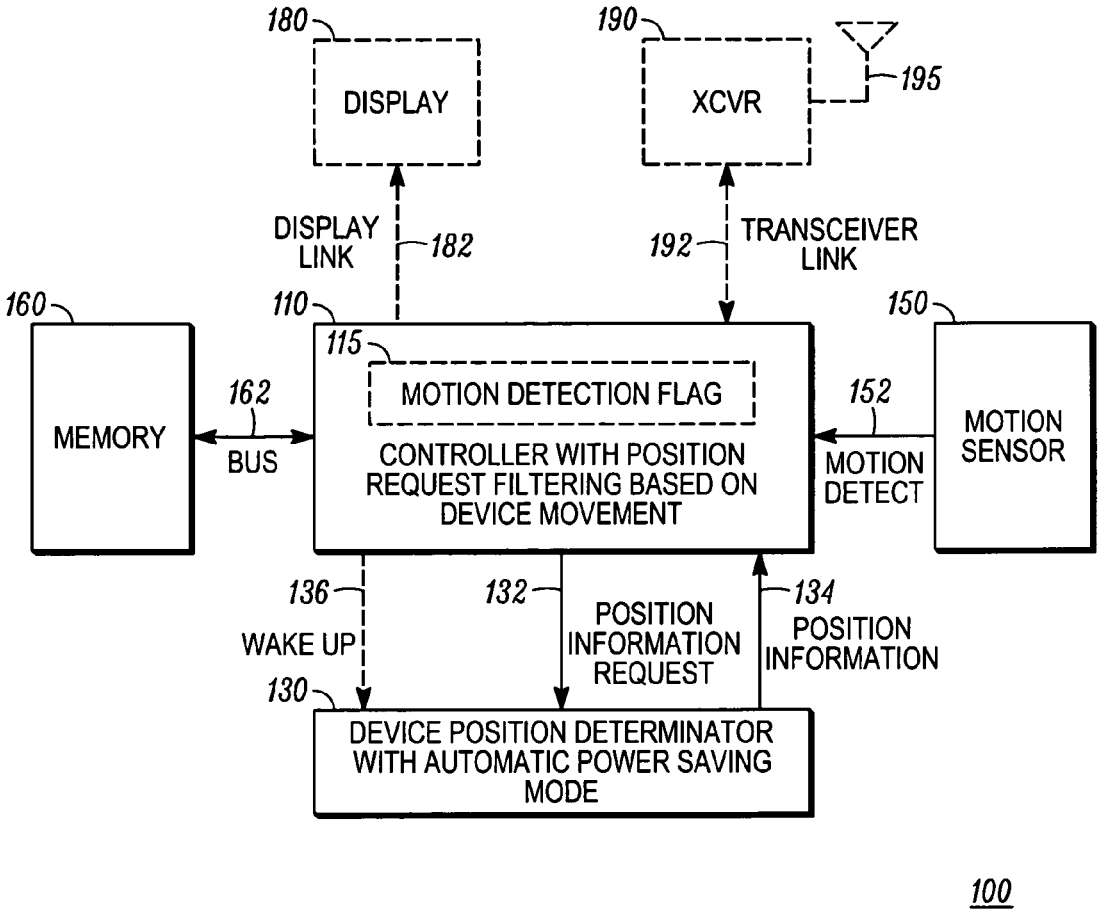
FIG. 1 is a schematic block diagram of a device employing one example of a power saving circuit in accordance with one embodiment of the invention.

FIG. 1 is a schematic block diagram of a device employing one example of a power saving circuit in accordance with one embodiment of the invention. The device 100 can be embodied as any suitable mobile communication device including, but not limited to, a global positioning device, a cellular telephone, an internet appliance, a laptop computer, a palmtop computer, a personal digital assistant, a digital entertainment device, a radio communication device, a tracking device, a personal training device, or a combination thereof such as a global positioning device accessory mechanically or electronically coupled to a communication device. For purposes of illustration only, a cellular telephone device is exemplified, and includes: a controller 110 with position request filtering based on device movement; a display 180; a memory 160; a cellular transceiver 190 and antenna 195; a device position determinator 130 with an automatic power savings mode; and a motion sensor 150.

In this example, the controller 110 executes software instructions obtained from the memory 160 via a memory bus 162 to control the operation of the device 100. The controller 110 is operatively coupled to the device position determinator 130. The controller 110 is operable to issue a request for position information 132 from the position determinator 130 and to receive position information 134 from the position determinator 130. The controller 110 is also operable to issue a wake up command to the device position determinator 130 to remove the device position determinator 130 from power saving mode. The controller 110 is operatively coupled to the motion sensor 150 and is operated to read or capture the motion detect 152 signal from the motion sensor 150 to determine if the device 100 has moved. The controller 110 may be operatively coupled to a cellular transceiver 190 via a transceiver link 192 to permit two way communications between the device 100 and, for example, a cellular network, not shown. The controller 110 may be operatively coupled to a display 180 via a display link 182 to permit display of various operating parameters including device position information. The controller 110 may be, for example, a DSP, microcontroller, central processing unit, baseband processor, co-processor, or any suitable processing device. In addition it may be discrete logic, or any suitable combination of hardware, software or firmware or any suitable structure.

Figure 2:
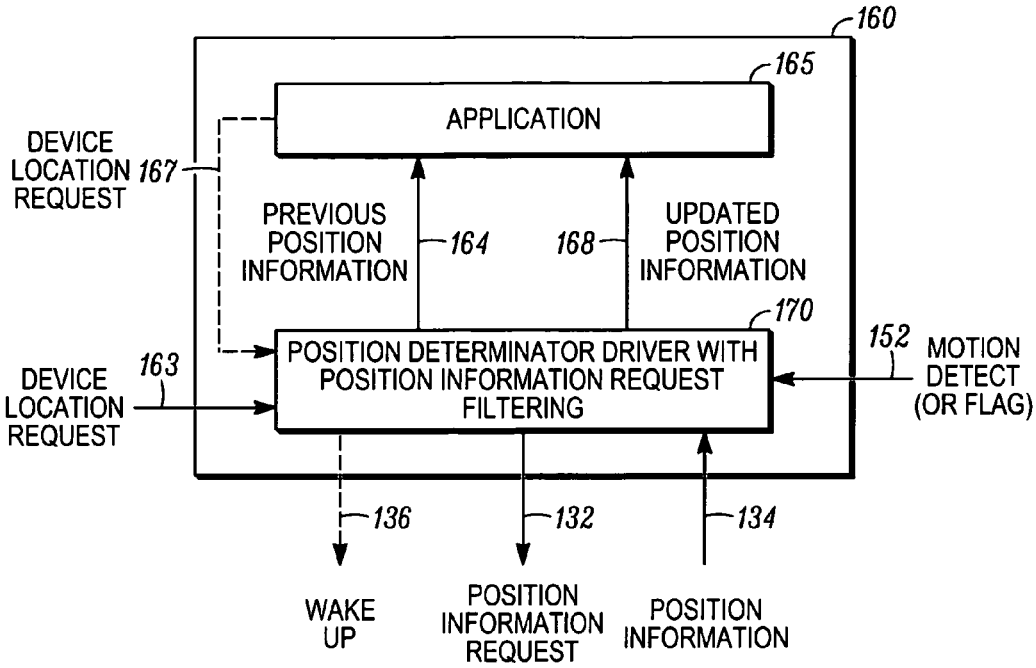
FIG. 2 is a schematic block diagram of a program employing one example of a position request filtering architecture in accordance with one embodiment of the invention.

FIG. 2 is a schematic block diagram of a program 160 employing one example of a position request filtering architecture in accordance with one embodiment of the invention. The operational instructions or software executing on the controller 110 may be stored in memory 160 which may include a single memory device or a plurality of memory devices. Such a memory device may include any memory element that stores digital data including, but not limited to, RAM, ROM, flash memory, hard disk drive, distributed memory such as servers on a network, or CD-ROM or any suitable storage medium. It will be recognized that such memory may be integrated with the controller or take any suitable configuration. An operating application 165 may be separate from the position determinator driver 170 such that the operating application 165 (the controller executing the application) communicates with the position determinator 130 to request and receive position information 134 through the position determinator driver 170. The operating application 165 may receive updated position information 168 from the position determinator driver 170 where the position determinator driver 170 has requested this information from the device position determinator 130. The operating application may also receive previous position information 164 from the position determinator driver 170. For example, if the device position determinator 130 is in a low power mode, then it may be useful for the position determinator driver 170 to return the previous position information 164 to the operating application 165 rather than to wake the device position determinator 130 via a position information request 132. The position determinator driver 170 generates position information requests 132 and receives position information 134 for the device position determinator 130. The position determinator driver 170 further receives the motion detect signal 152, or flag, from the motion sensor 150.

A device location request 163 and 167 may be generated internal or external to the program 160. For example, an internal device location request 167 may be generated by the operating application 165 if the operating application 165 is programmed to monitor the device location on a periodic basis. Alternatively, a device location request 163 may be generated externally from the operating application, such as in the case of a request received over the transceiver 190. In either case, the device position determinator 170 provides filtering of the device location request 163 or 167 by selectively issuing position information requests 132. The position determinator driver 170 filters issuance of position information requests by determining if the device has moved far enough to trigger a request based on data from the motion detect signal 152.

Referring again to FIG. 1, the display 180 provides a graphical output showing various operating parameters including device location information. This position information may be displayed on the display 180 as part of a mapping or navigation program or other display application for further use therein.

The cellular transceiver 190 includes an antenna 195 and modulation and/or demodulation circuitry capable of converting, for example, voice and/or data, present in satellite or non-satellite network data into signals having a format suitable for manipulation and processing by the controller 110. Voice and/or data may be provided by controller 110 to the cellular transceiver 190 via the transceiver link 192 for transmission over a cellular network or other network or networks. Position information 134 derived from the device position determinator 130 may be provided by controller 110 to the cellular transceiver 190 for transmission over a cellular network to facilitate, for example, remote tracking of the device 100.

The device position determinator 130 generates position information 134 (e.g. x-y coordinates, latitude/longitude coordinates, or other suitable information from which to derive the location) relating to the location of the device 100 by processing position signals according to a suitable protocol. The controller 110 issues position requests 132 to the device position determinator 130. The device position determinator 130 generates and returns the position information 134 to the controller 110. Additionally, the position information 134 may be used in the controller 110 in a variety of ways, such as but not limited to providing the position information 134 to the cellular transceiver 190 for transmission to a central location (not shown) for additional processing, such as for use in child tracking, displaying the position information 134 on the display 180 as part of a mapping or navigation program or other display application for further use therein, or storing the position information 134 in the telephone memory 160.

Figure 3:
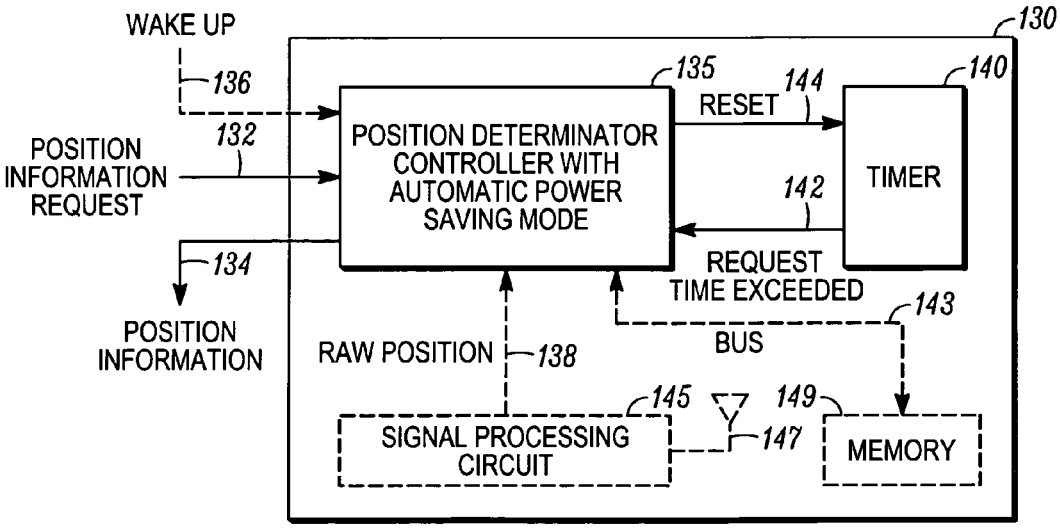
FIG. 3 is a schematic block diagram of a device position determinator employing one example of a power saving circuit in accordance with one embodiment of the invention.

FIG. 3 is a schematic block diagram of a device position determinator employing one example of a power saving circuit in accordance with one embodiment of the invention. The device position determinator 130 includes a controller 135 and a timer 140. The device position determinator 130 may be implemented as any suitable type of position determinator as known in the art, such as, but not limited to, a GPS or other satellite-based receiver, a time difference of arrival (TDOA) algorithm, access point (AP) location databases over WLAN, inertial navigation system, or a hybrid solution. Some implementations further require a signal processing circuit 145 and an antenna 147. For example, an external signal, such as a GPS signal or a non-satellite signal, may be received by the antenna 147 and processed, such as by filtering and de-modulating, by the signal processing circuit 145. The position determinator controller 135 receives a raw position processed signal 138 from the signal processing circuit 145 and generates position information 134 based thereon. The controller 140 may be implemented in any suitable structure such as, but not limited to, a digital signal processor (DSP), a dedicated piece of hardware (e.g. ASIC), discrete logic circuitry, state machine or any device that manipulates signals based on operational instructions or software executing on one or more processing devices, capable of generating position information based on the position signals, firmware or any suitable combination thereof. The operational instructions or software would be stored in a memory, such as the device memory 160, which may include a single memory device or a plurality of memory devices. Such a memory device may include any memory element that stores digital data including, but not limited to, RAM, ROM, flash memory, hard disk drive, distributed memory such as servers on a network, or CD-ROM. Alternatively, the device position determinator 130 may have its own dedicated memory 149 operatively coupled through bus 143 to the position determinator controller 135. Operational instructions or software executing on the position determinator controller 135 may be stored in dedicated memory 149 which may include a single memory device or a plurality of memory devices. Such a memory device 149 may include any memory element that stores digital data including, but not limited to, RAM, ROM, flash memory, hard disk drive, distributed memory such as servers on a network, or CD-ROM or any suitable storage medium. The position determinator controller 135 receives position requests from the device controller 110. The position determinator controller 135 generates and returns the position information 134 to the telephone controller 105.

To reduce power consumption, the device position determinator 130 has a low power consumption mode. Low power consumption mode is achieved by in any suitable means, as is known in the art, such as turning off clocks or powering off specific circuits in the determinator 130. The device position determinator 130 enters low power consumption mode whenever the controller 110 does not request position information over a request time period. The position determinator controller 135 is operatively coupled to a timer 140. The timer generates a request time exceeded signal 142 when a position information request 132 has not been received for a period of time in excess of the preset request time period. If a position information request 132 is received, then the position determinator controller 135 resets the timer 140. The timer 140 may be implemented in any suitable structure such as, but not limited to, a dedicated piece of hardware (e.g. ASIC), discrete logic circuitry, state machine or any device that manipulates signals based on operational instructions or software executing on one or more processing devices, capable of counting, firmware or any suitable combination thereof.

The device position determinator 130 is configured to exit low power mode whenever a position information request 132 is received from the controller 110. During low power mode, the device position determinator 130 is able to detect the presence of incoming commands from the telephone controller 110 and is, therefore, not completely powered down. For example, the device position determinator 130 may wake from the low power mode upon sensing the presence of an incoming command, such as a position information request. After waking, the device position determinator 130 is able to receive and process this request. Alternatively, the device position determinator 130 may be is configured to exit low power mode whenever a wake up command is received from the controller 110.

Referring again to FIG. 1, the motion sensor 150 detects if the device 100 moves. The motion sensor 150 may be implemented as any suitable type of motion sensor as known in the art, such as, but not limited to, an accelerometer, a gyroscope, a magnetic compass, or a time differential of arrival (TDOA) change detection algorithm. In an exemplary embodiment, the motion sensor 150 comprises a piezoelectric accelerometer and further includes an amplifier, a peak detector, and a latching circuit to detect the movement of the device 100 within a certain time window. A motion detection flag 115 may be included in the controller 110. The motion detection flag 115 is set or cleared when the motion sensor 150 detects a sufficiently large acceleration or movement. The controller 110 may use the motion detection flag 115 to determine whether to request device position from the device position determinator 130. If, for example, the motion sensor 150 indicates to the controller 110 that the device 100 has not moved over a period of time, then the controller 110 may stop issuing position information requests 132 to the device position determinator 130. Power consumption is thereby reduced because the device position determinator 130 is not actively responding. Further, if the device position determinator 130 does not receive position information requests 132 over a period of time, then the device position determinator 130 will automatically enter a low power consumption mode. The motion sensor 150 is preferably configured to exhibit very low current drain such that continuous operation of the motion sensor 150 does not cause significant battery drain.

Figure 4:
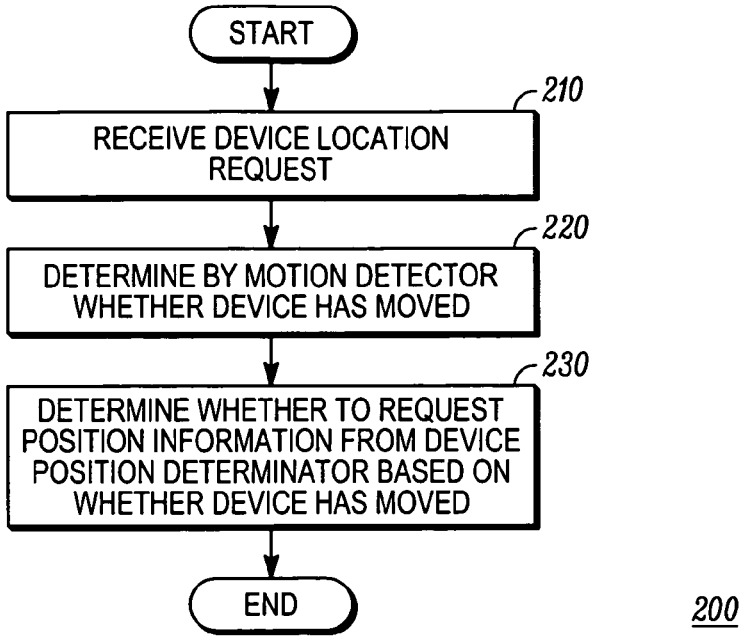
FIG. 4 is a flowchart of operating steps performed employing one example of a position information request filtering method in accordance with one embodiment of the invention.

FIG. 4 is a flowchart of operating steps performed employing one example of a position information request filtering method in accordance with one embodiment of the invention. The process 200 begins at step 210 where a device location request is received for the battery powered device. This request may come, for example, as a request from a cellular network that is received through the cellular transceiver 190. As another example, internal tracking software within the telephone memory 160 and executed by the controller 110 may request position information. In step 220, a determination is made as to whether the battery powered device has moved based on the motion detector. To determine movement, the controller 110 analyzes the motion detect signal 152 from the motion sensor 150. If the motion detect signal 152, or alternatively the motion detection flag 115 that is based on the motion detect signal 152, indicates movement then the device 100 is determined to have moved. In one example, the motion detection flag 115 is cleared each time the device position determinator 115 returns position information 134 to the controller 110. In this case, movement is determined to have occurred, or to have not occurred, since the last position information update. In step 230, a determination is made as to whether to request position information from the device position determinator based on whether the battery powered device has moved.

Figure 5:
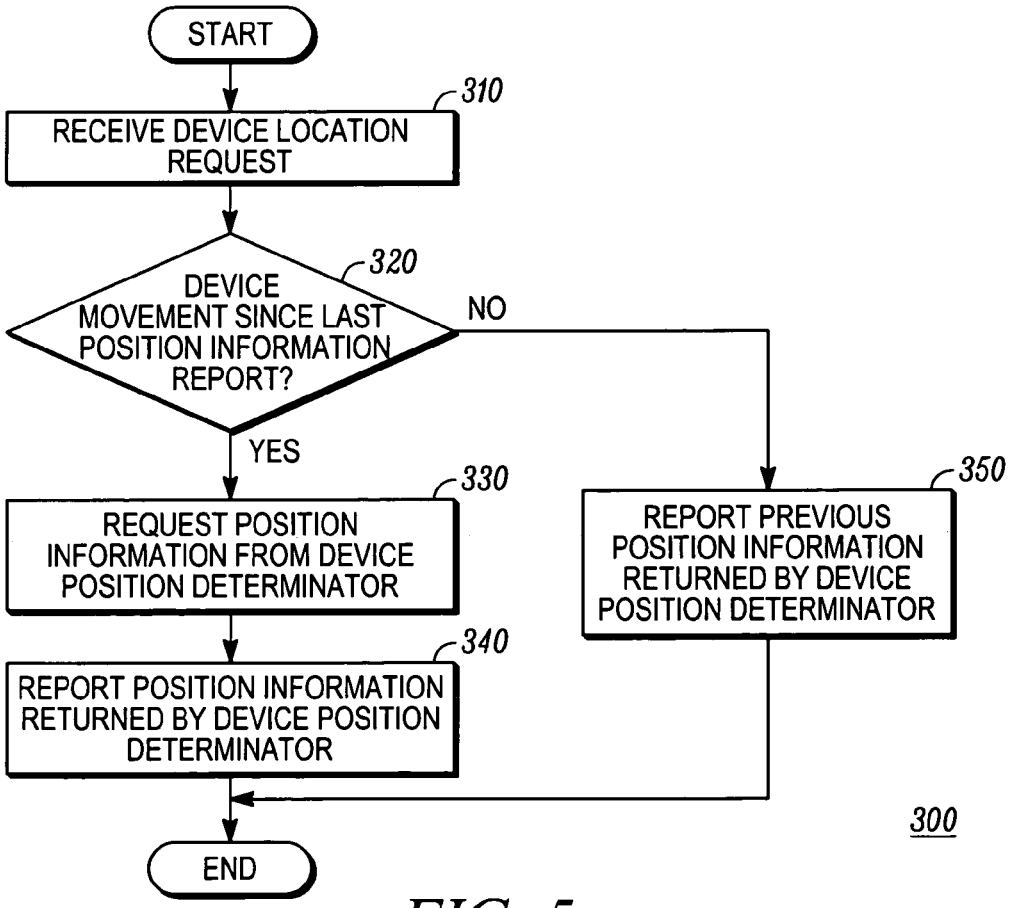
FIG. 5 is a flowchart of operating steps performed employing one example of a position information request filtering method in accordance with one embodiment of the invention.

FIG. 5 is a flowchart of operating steps performed employing another example of a position information request filtering method in accordance with one embodiment of the invention. In this example, previous position information is reported by the controller 110 when the device 100 is determined to be in a non-moving condition. The process 300 begins at step 310 where a device location request is received for the battery powered device. The process continues at step 320, where a determination is made whether the device 100 has moved. If movement is detected, then the process proceeds to step 330 where a request for position information 132 is issued to the device position determinator 130. In step 340, the device position determinator 130 derives the position, according to a GPS or other suitable position measurement protocol, and reports the position information 134 to the controller 110. If movement is not detected in step 320, then the process proceeds to step 350 where the controller 110 reports the previous position information returned by the device position determinator 130. Step 350 allows the controller 110 to report position information 134 when, for example, the device position determinator 130 is in low power consumption mode. Alternatively, the controller 130 may simply report a non-reading or otherwise indicate that the device position determinator 130 is not reporting a position.

Figure 6:
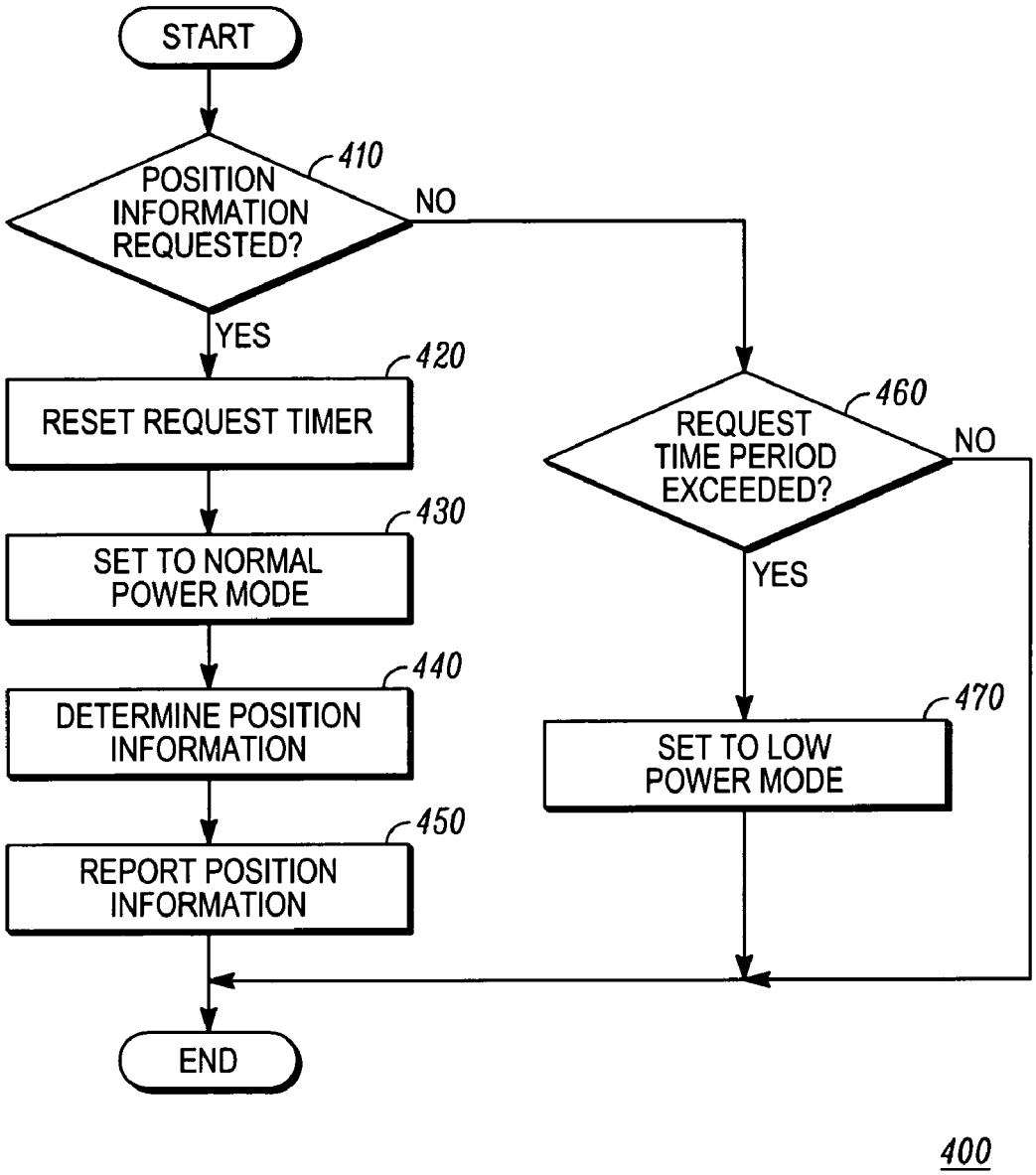
FIG. 6 is a flowchart of operating steps performed employing one example of a power saving method in a device position determinator in accordance with one embodiment of the invention.

FIG. 6 is a flowchart of operating steps performed employing one example of a power saving method in a device position determinator in accordance with one embodiment of the invention. The process 400 begins at step 410 where a determination is made as to whether the controller 110 has requested position information from the device position determinator 115. If the controller 110 has not requested a position, then the process proceeds to step 460. In step 460, a determination is made as to whether a request time period has been exceeded. If a position information request is not received over a period exceeding the request time period, then the process proceeds to step 470 where the device position determinator 130 is switched to a low power consumption mode. If the controller 110 is determined, in step 410, to have issued a position information request to the device position determinator 130, then the process proceeds to step 420 where the Request Timer is reset. Then the process proceeds to step 430 where the device position determinator 130 is set to normal power mode. The process continues to step 440 where the device position determinator 130 determines the position information according to a GPS or other suitable position measurement protocol. The process continues to step 450 where the determinator 130 reports the position information 134 to the controller 130.

The above detailed description of the invention and the examples described therein have been presented for the purposes of illustration and description. While the principles of the invention have been described above in connection with a specific device, it is to be clearly understood that this description is made only by way of example and not as a limitation on the scope of the invention.

What is claimed is:

1. A method for saving power for an energy constrained device comprising:

receiving a device location request for the energy constrained device;

determining a location of the energy constrained device using a device position determinator;

storing the determined location in a memory;

placing the device position determinator in a low power mode;

receiving a motion detect signal from a motion detector;

determining by the motion detector whether the energy constrained device has moved based on the motion detect signal;

determining whether to request position information from the device position determinator based on whether the energy constrained device has moved beyond a desired amount;

waking the device position determinator from the low power mode when the device has been determined to moved beyond a desired amount; and receiving a location of the energy constrained device from the device position determinator based on the waking.

2. The method of claim 1 further comprising reporting a previous device position information returned by the device position determinator when the energy constrained device has been determined not to have moved since the previous position information was returned.

3. The method of claim 1 wherein determining whether to request position information comprises:

if motion has been detected, requesting position information from the device position determinator; and if no motion has been detected, not requesting position information from the device position determinator.

4. The method of claim 1 wherein determining by a motion detector whether the energy constrained device has moved comprises determining the state of a motion detection flag.

5. The method of claim 1 wherein the device position determinator is one of a time difference of arrival algorithm, access point location databases over WLAN, and an intertial navigation system.

6. An energy constrained device comprising:

a motion sensor operative to detect motion of the device;

a device position determinator; and a controller operatively coupled to the motion sensor and to the device position determinator and operative to receive a device location request for the energy constrained device, to determine whether the energy constrained device has moved based on the motion sensor, and to determine whether to request position information from the device position determinator based on device movement and wherein the controller is operative to place the device position determinator in a low power state and wherein the controller is operatively coupled to the motion sensor and operative to determine whether the energy constrained device has moved based on the motion sensor and wherein the controller is operative to report a previous position returned by the device position determinator if the device has not moved since the previous position information was returned.

7. The device of claim 6 wherein the controller is operative to report a previous device location if the device has not moved since the previous position information was returned.

8. The device of claim 6 further comprising a register operative to store a flag whenever the energy constrained device has moved.

9. The device of claim 6 wherein the device position determinator is operative to automatically switch to a low power consumption state if position information is not requested during a request time period.

10. The device of claim 6 further comprising a wireless transceiver operatively coupled to the controller.

11. The device of claim 6 wherein the device position determinator is one of a time difference of arrival algorithm, access point location databases over WLAN, and an inertial navigation system.

12. A method for saving power for a device position determinator in an energy constrained device comprising:

establishing a request time period;

receiving a request for position information;

determining whether position information has been requested from the device position determinator within the established request time period; and if not, automatically switching the device position determinator to a low power consumption mode.

13. The method of claim 12 further comprising the steps of:

determining by a motion detector whether the energy constrained device has moved; and if not, not requesting position information from the device position determinator.

14. The method of claim 12 further comprising the step of reporting a previous device position returned by the device position determinator when the energy constrained device has not moved since the previous position information was returned.

15. The method of claim 12 wherein the device position determinator is one of a time difference of arrival algorithm, access point location databases over WLAN, and an inertial navigation system.

16. An energy constrained device comprising:

a device position determinator operative to determine whether position has been requested from the device position determinator and, if not, to automatically go a low power consumption mode;

a controller operatively coupled to the device position determinator and operative to receive a device location request for the energy constrained device and to request position information from the device position determinator;

a motion sensor wherein the controller is operatively coupled to the motion sensor and operative to determine whether the energy constrained device has moved based on the motion sensor and wherein the controller is operative to report a previous position returned by the device position determinator if the device has not moved since the previous position information was returned.

17. The device of claim 16 further comprising a wireless transceiver operatively coupled to the controller.

18. A method for saving power for an energy constrained device comprising:

receiving a device location request for the energy constrained device;

determining a location of the energy constrained device using a device position determinator;

storing the determined location in a memory;

placing the device position determinator in a low power mode;

receiving a motion detect signal from a motion detector;

determining by the motion detector whether the energy constrained device has moved based on the motion detect signal;

determining whether to request position information from the device position determinator based on whether the energy constrained device has moved;

waking the device position determinator from the low power mode;

receiving a location of the energy constrained device from the device position determinator based on the waking;

determining, by the device position determinator, whether position information has been requested from the device position determinator during a request time period; and if not, switching, the device position determinator to a low power consumption mode.

* * * * *